US006424944B1

(12) United States Patent
Hikawa

(10) Patent No.: US 6,424,944 B1
(45) Date of Patent: Jul. 23, 2002

(54) SINGING APPARATUS CAPABLE OF SYNTHESIZING VOCAL SOUNDS FOR GIVEN TEXT DATA AND A RELATED RECORDING MEDIUM

(75) Inventor: Kazuo Hikawa, Yokohama (JP)

(73) Assignee: Victor Company of Japan Ltd., Yokohama (JP)

( * ) Notice: Subject to any disclaimer, the term of this patent is extended or adjusted under 35 U.S.C. 154(b) by 0 days.

(21) Appl. No.: 09/374,115

(22) Filed: Aug. 16, 1999

(30) Foreign Application Priority Data

Sep. 30, 1998 (JP) ..... 10-277120

(51) Int. Cl.[7] ..... G10L 13/08

(52) U.S. Cl. ..... 704/260; 84/609; 84/610; 84/622; 84/645; 704/258; 704/267; 704/268

(58) Field of Search ..... 704/260, 258, 704/267, 268; 84/609, 610, 622, 645; 437/307

(56) References Cited

U.S. PATENT DOCUMENTS

| | | | | | |
|---|---|---|---|---|---|
| 3,838,217 | A | * | 9/1974 | Dreyfus | 179/1 |
| 4,771,671 | A | * | 9/1988 | Hoff, Jr. | 84/1.01 |
| 5,129,303 | A | * | 7/1992 | Coles | 84/685 |
| 5,703,311 | A | * | 12/1997 | Ohta | 84/622 |
| 5,712,953 | A | * | 1/1998 | Langs | 704/214 |
| 5,857,171 | A | * | 1/1999 | Kageyama et al. | 704/268 |
| 5,915,238 | A | * | 6/1999 | Tjaden | 704/260 |
| 5,939,654 | A | * | 8/1999 | Anada | 84/610 |

* cited by examiner

*Primary Examiner*—Vijay B Chawan
(74) *Attorney, Agent, or Firm*—Connolly Bove Lodge & Hutz LLP

(57) ABSTRACT

A text analyzing section converts given text data into syllable data. A melody producing section receives the converted syllable data together with the text data and a standard MIDI file. The syllable data are assigned to a melody of the standard MIDI file and sent to a sequencer section. A software synthesizer converts the syllable data into vocal sounds with the interval variable in accordance the melody.

16 Claims, 6 Drawing Sheets

FIG. 4

| PRONUNCIATION | MSB | LSB |
|---|---|---|
| [a] | 00 | 00 |
| [i] | 00 | 01 |
| [u] | 00 | 02 |
| [e] | 00 | 03 |
| [wo] | 00 | 04 |
| ・・・・ | | |
| [gya] | XX | XX |
| [gyu] | XX | XX |
| [gyo] | XX | XX |
| ・・ | | |
| [n] | XX | XX |

SINGING APPARATUS CAPABLE OF SYNTHESIZING VOCAL SOUNDS FOR GIVEN TEXT DATA AND A RELATED RECORDING MEDIUM

BACKGROUND OF THE INVENTION

The present invention relates to a singing or vocal sound synthesizing apparatus which converts given text data into words of an arbitrary song and generates synthesized vocal sounds in accordance with a preferable melody.

Various read or narration apparatuses, which are conventionally known as voice synthesizers, generate vocal sounds with natural speaking intonations.

On the other hand, there is a requirement of synthesizing the vocal sounds with a melody. However, when the given text data are not related to a selected melody, it is generally difficult to match the text data with the melody.

SUMMARY OF THE INVENTION

An object of the present invention is to provide an apparatus and a method for automatically matching the given text data to an arbitrarily selected melody.

Another object of the present invention is to provide a recording medium storing a software program performing the singing or vocal sound synthesizing operation of the present invention.

To accomplish the above and other related objects of the present invention, the present invention provides a singing apparatus comprises a syllable conversion means for converting text data into syllable information, a vocal interval information generating means for generating vocal interval information, an assigning means for automatically assigning the syllable information received from the syllable conversion means to the vocal interval information supplied from the vocal interval information generating means, and an output means for generating the vocal sound of the assigned syllable information so as to have an interval variable in accordance with the corresponding vocal interval information.

When a playing or performance time is dependent on the vocal interval information, it is preferable that the assigning means is for performing the assignment of the syllable information according to the vocal interval information in such a manner that the playing or performance time can be varied in accordance with a syllable number of the syllable information.

When the vocal interval information involves a total number of notes of a melody, it is preferable that the assigning means is for performing the assignment of the syllable information according to the vocal interval information in such a manner that the number of notes of the melody is changed in accordance with the syllable number of the syllable information.

It is also preferable that the assigning means is for performing the assignment of the syllable information according to the vocal interval information by selecting an optimum one of melodies stored in the vocal interval information generating means.

A separating means may be provided for separating the syllable information into a plurality of syllable groups, and the assigning means is for assigning each of the separated syllable groups to the vocal interval information.

A backing information generating means may be provided for generating backing or accompaniment information, and the output means is for generating backing or accompaniment in synchronism with the vocal sound of the syllable information which is generated in accordance with the vocal interval information.

A performance information storing means may be provided for storing playing or performance information including the vocal interval information and the backing or accompaniment information. In this case, the backing information generating means is for generating selected one of a plurality kinds of the backing or accompaniment information involved in the playing or performance information stored in the performance information storing means.

Another aspect of the present invention provides a recording medium storing a program performing steps of converting given text data into syllable information, assigning the syllable information to desirable vocal interval information, and generating vocal sound of assigned syllable information so as to have an interval variable in accordance with a melody of the vocal interval information.

Another aspect of the present invention provides a recording medium storing playing or performance information including backing or accompaniment information to be reproduced as a background music, and vocal interval information to be assigned to syllable information.

Furthermore, another aspect of the present invention provides a vocal sound synthesizing method comprising the steps for realizing the above-described singing or vocal sound synthesizing operations.

BRIEF DESCRIPTION OF THE DRAWINGS

The above and other objects, features and advantages of the present invention will become more apparent from the following detailed description which is to be read in conjunction with the accompanying drawings, in which:

FIG. 4 is a table showing detailed examples of MSB and LSB used in an NRPN message;

DESCRIPTION OF THE PREFERRED EMBODIMENT

Figure 1:
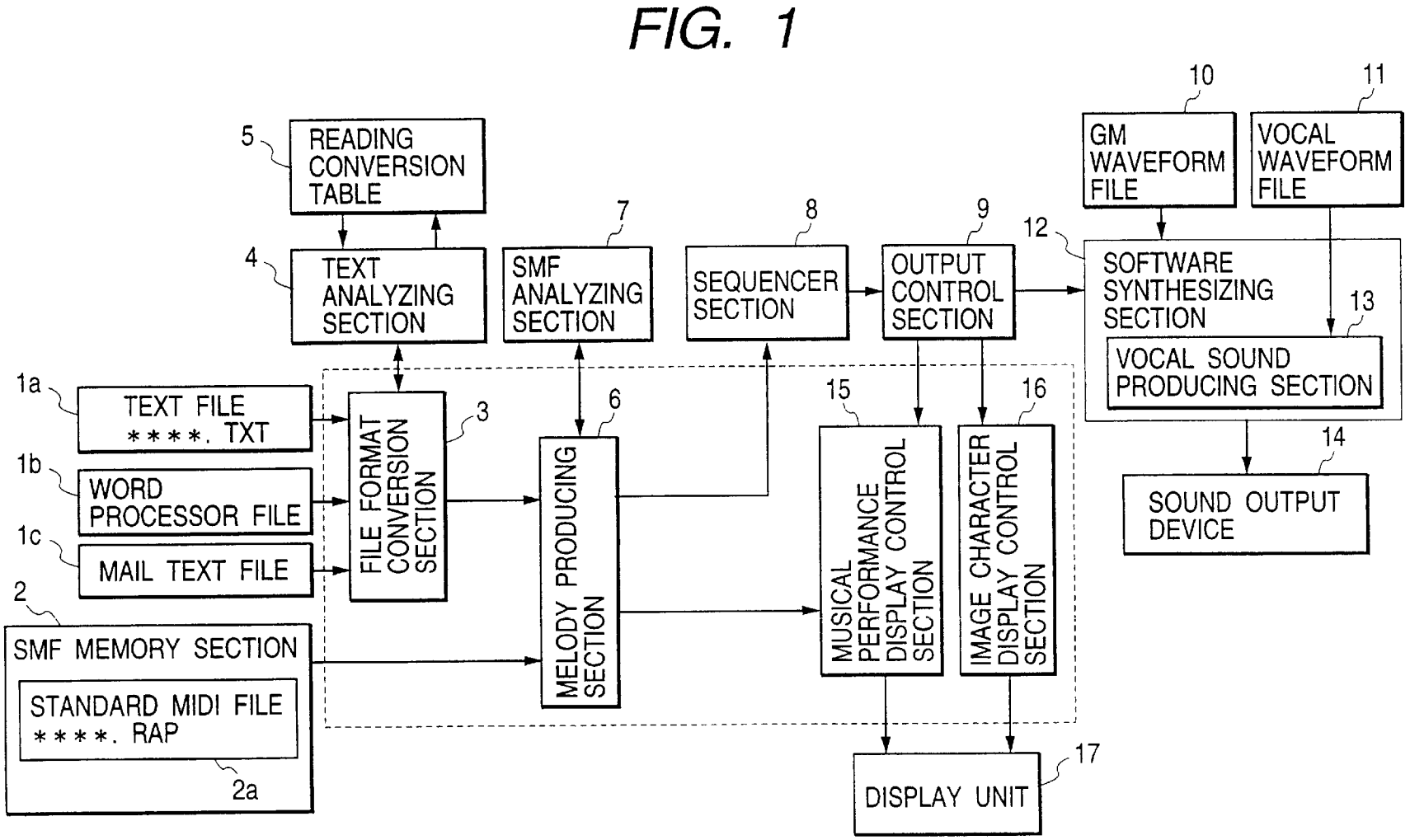
FIG. 1 is a block diagram showing a detailed arrangement of a singing apparatus in accordance with a preferred embodiment of the present invention.

A preferred embodiment of the present invention will be explained with reference to the accompanying drawings. Identical parts are denoted by the same reference numerals throughout the views.

Figure 7:
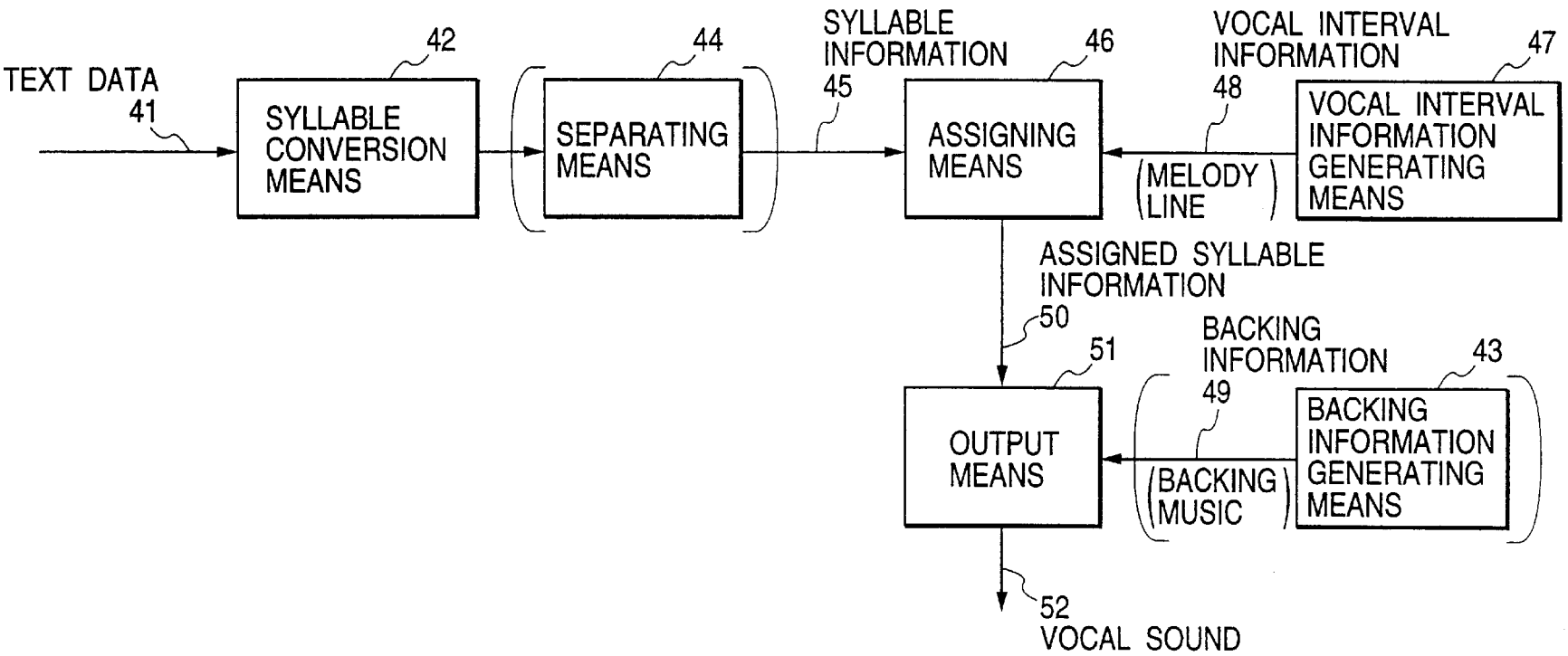
FIG. 7 is a schematic block diagram showing the singing apparatus in accordance with the preferred embodiment of the present invention.

FIG. 7 is a schematic block diagram showing the singing apparatus in accordance with the preferred embodiment of the present invention.

A text data 41 is supplied to a syllable conversion means 42 and converted into syllable information 45. An assigning means 46 is provided for receiving the converted syllable information 45 supplied from the syllable conversion means 42. A vocal interval information generating means 47 is provided for generating vocal interval information 48. The vocal interval information 48 is supplied to the assigning means 46. The assigning means 46 automatically assigns the syllable information 45 received from the syllable conversion means 42 to the vocal interval information 48 supplied from the vocal interval information generating means 47. An output means 51 is provided for receiving assigned syllable information 50 from the assigning means 46. The output means 51 converts the assigned syllable information 50 into vocal sound 52 so as to have the interval variable in accordance with the corresponding vocal interval information 48. Thus, the text data 41 is finally converted into vocal sound 52.

The assigning means 46 can perform the assignment of the syllable information 45 according to the vocal interval information 48 in such a manner that, when a playing or performance time is dependent on the vocal interval information 48, the playing or performance time can be varied in accordance with a syllable number of the syllable information 45. Alternatively, when the vocal interval information 48 involves a total number of notes of the melody, it is also possible to change the number of notes of the melody in accordance with the syllable number of the syllable information 45. Furthermore, the assignment of the syllable information 45 can be performed by selecting an optimum one of melodies stored in the vocal interval information generating means 47.

Furthermore, it is possible to additionally provide a separating means 44 in (or next to) the syllable conversion means 42 for separating the syllable information 45 into a plurality of syllable groups so that each of the separated syllable groups can be assigned to the vocal interval information 48.

A backing information generating means 43 is provided for generating backing or accompaniment information 49. The backing or accompaniment information 49 is supplied to the output means 51. The output means 51 generates the backing or accompaniment in synchronism with the vocal sound 52 of the syllable information 45 which is generated in accordance with the vocal interval information 48. In other words, the singing apparatus can generate a song accompanied by a backing music.

Furthermore, it is possible to provide a performance information storing means (not shown) for storing playing or performance information including the vocal interval information 48 as well as the backing or accompaniment information 49. In this case, it becomes possible to obtain the vocal interval information 48 and the backing or accompaniment information 49 from this performance information storing means. The backing information generating means 43 can generate optimum backing information stored in the performance information storing means.

It is also possible to combine the vocal interval information generating means 47 and the backing information generating means 43 as an integrated performance information storing means.

The singing apparatus of the present invention can be embodied by a personal computer. The functions of the singing apparatus can be stored as a application software. In other words, a recording medium is provided for storing a program which realizes the singing or vocal sound synthesizing operations of the present invention. According to the program stored in the recording medium, the given text data is converted into the syllable information. The syllable information is assigned to desirable vocal interval information. Each assigned syllable information is converted into the vocal sound having the interval variable in accordance with the melody line involved in the vocal interval information.

Furthermore, it is possible to provide a recording medium as a supplying means for supplying the performance information (or as the performance information storing means) which is capable of storing the backing information to be reproduced as background music in addition to the vocal interval information to be reproduced in accordance with the syllable information.

Hereinafter, a preferable embodiment of the singing apparatus of the present invention will be explained with reference to FIG. 1.

The text data 41 disclosed in FIG. 7 comprises various data, such as a text file 1*a*, a word processor file 1*b* and a mail text file 1*c* which become words of songs. The text data 41 may be words created by a word processor or a word-processor software, character data received by an e-mail, or data on a clipboard. The text file 1*a*, the word processor file 1*b* and the mail text file 1*c* are formatted in accordance with predetermined file formats or character codes (e.g., Shft#JIS, UNICODE, EUC etc.) and are entered in a file format conversion section 3. The file format conversion section 3 operates as the syllable conversion means 42 and the separating means 44 shown in FIG. 7.

More specifically, the file format conversion section 3 converts the format of text data 1*a*, 1*b* and 1*c* formatted in accordance with various file formats or character codes into a predetermined data format for analysis. A text analyzing section 4 receives the converted text data.

The text analyzing section 4 analyzes the character data sent from the file format conversion section 3 to separate the character data into a plurality of groups. For example, a sentence is separated into several phrases or into a plurality of words with accompanying particles. A reading conversion table 5 is provided to select optimum or correct pronunciation when the text data involve Chinese or Japanese characters. Thus, the text analyzing section 4 produces a syllable data file comprising the separated clauses. The file format conversion section 3 receives the syllable data file sent from the text analyzing section 4.

For example, the reading conversion table 5 has a character conversion table for selecting an optimum pronunciation of the given character. For example, a Chinese character conversion table is provided for selecting an optimum pronunciation of the given Chinese character. A symbol table may be provided to designate a correct pronunciation for a given symbol (%, &, =, - - - , +, etc.).

Furthermore, a color change information file is produced. The color change information represents a positional relationship between the text data file and the syllable of the syllable data file (i.e., syllable information 45). For example, the position of each syllable in the syllable data file can be identified by a byte number from the head of the text data file. Thus, the color change information file describes respective positions of syllables arrayed from the head of the syllable data file in the units of bytes.

The text data file, the syllable data file, and the color change information file are sent from the file format conversion section 3 to a melody producing section 6. The melody producing section 6 operates as the assigning means 46 shown in FIG. 7.

There is a SMF memory section 2 storing standard MIDI files for producing music. The SMF memory section 2 operates as the backing information generating means 43 and the vocal interval information generating means 47.

Figure 2:
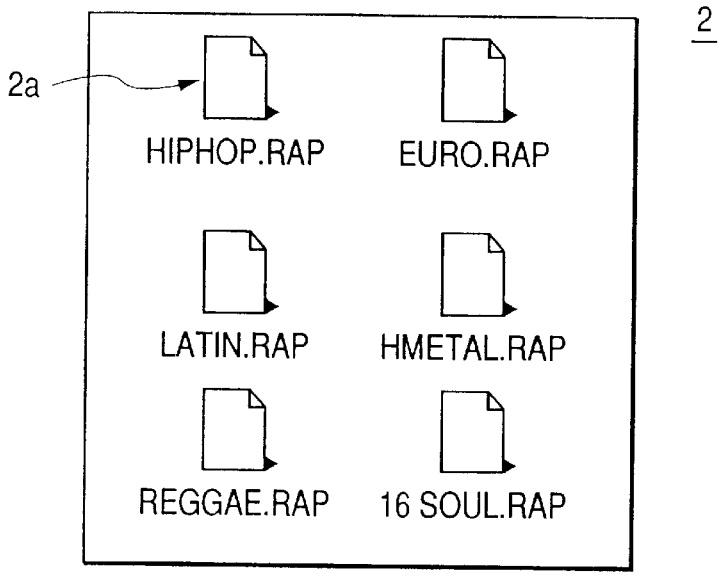
FIG. 2 is a view showing an example of standard MIDI files memorized in a SMF memory section in the singing apparatus shown in FIG. 1.

FIG. 2 shows practical standard MIDI files 2*a* of a plurality kinds of music genres, such as Rap, and Hiphop. Each standard MIDI file 2*a* stores MIDI data for reproducing backing music as well as vocal sounds.

In the SMF melody section 2, a preferable MIDI file 2*a* is selected arbitrarily or according to user's preference. The selected MIDI file 2*a* is sent to the melody producing section 6. The file for storing the playing or performance information is not limited to the MIDI file. It is possible to replace the MIDI file by any other file which has a format for describing the musical information.

The melody producing section 6 determines the overall arrangement of a melody based on the entered syllable data. More specifically, the selected MIDI file 2*a* is sent to the SMF analyzing section 7. The SMF analyzing section 7 returns the analysis result to the melody producing section 6.

Figure 3:
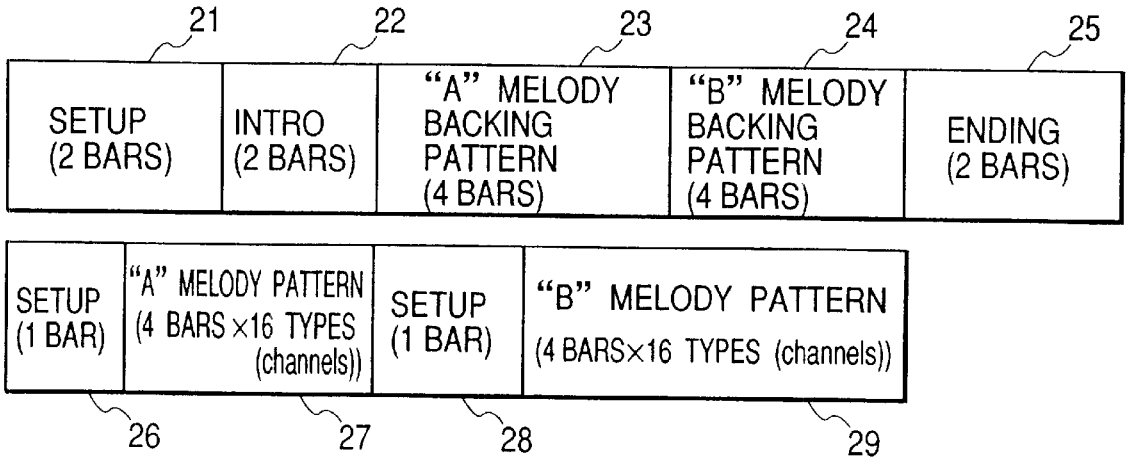
FIG. 3 is a view showing a detailed format of a standard MIDI file shown in FIG. 2.

FIG. 3 is a view showing a detailed format of a standard MIDI file 2*a* shown in FIG. 2. The standard MIDI file 2*a* consists of the backing or accompaniment information 49 (i.e., setup data 21, intro data 22, "A" melody backing pattern data 23, "B" melody backing pattern data 24, and ending data 25) and the vocal interval information 48 (i.e., setup data 26, a plurality types of "A" melody pattern data 27, setup data 28, and a plurality types of "B" melody pattern data 29).

The melody data comprise a plurality of melody lines with numerous variations which are described, as performance data, in a plurality of MIDI channels and are selectively reproducible in accordance with playback conditions.

Furthermore, in each standard MIDI file 2*a*, a head track succeeding a header chunk is designated as a conductor track (not shown) which is used for the information administrating the tempo of a song. At least one conductor track, constructed by Meta Event, exists in each standard MIDI file 2*a*.

At the head (Δt=0) of the conductor track, a file name of the standard MIDI file 2*a* is described in the text format by using Sequence/Track Name Meta Event (Text Meta Event is not available). At the next portion (Δt=0), an objective sound source group code is described by using the Text Meta Event, in the following manner.

(Δt=0) Sequence/Track Name Meta Event="file name. extension"

(Δt=0) Text Meta Event="objective sound source group code"

For example, a standard MIDI file is for producing hiphop music.

(Δt=0) Sequence/Track Name Meta Event="HIPHOP. RAP"

(Δt=0) Text Meta Event=GM (i.e., General Midi).

Returning to FIG. 1, the melody producing section 6 receives the text data file, the syllable data file, and the color change information file from the file format conversion section 3, and also receives the standard MIDI file 2*a* from the SMF memory section 2.

The music described in the standard MIDI file 2*a* consists of the intro part, the melody part, and the ending part. All of the text is allocated to the melody part which consists of the two kinds of melodies (i.e., "A" melody and "B" melody). The playing or performance time of the music is properly adjusted in accordance with the total number of syllables included in the entered syllable data file. For example, the adjustment is performed by determining the number of melodies to be inserted or repeated and also by selecting the combination pattern of "A" melody and "B" melody.

As shown in FIG. 3, each of "A" melody pattern 27 and "B" melody pattern 29 includes a total of 16 variation patterns recorded in 16 MIDI channels arranged in parallel to each other on time basis. The number of notes involved in each melody pattern is also recorded in the corresponding MIDI channel. For example, the note number data, such as ch 1(channel 1)=31, ch2=23, ch=43, - - - , are described in the standard MIDI file 2*a* by using Text Meta Event.

When the standard MIDI file 2*a* is entered, the melody producing section 6 selects an adequate variation pattern in response to the selection of each melody. For example, the selection is performed by successively referring to fixed combinations of respective channels of "A" melody pattern 27 and respective channels of "B" melody pattern 29. Each fixed combination is a circulatory pattern of "A" melody and "B" melody, such as A-B-A-B- - - - , AA-BB-AA-BB- - - - .

It is now assumed that the circulatory pattern A-B-A-B- - - - is selected. First, one of variation patterns is arbitrarily selected from the channels of "A" melody pattern 27. Then, the number of notes involved in the selected variation pattern is detected. Similarly, one of variation patterns is arbitrarily selected from the channels of "B" melody pattern 29 to detect the number of notes involved in the selected variation pattern. Regarding arbitrary selection of the variation pattern, it is performed randomly or in accordance with a predetermined order or rule.

Thereafter, returning to "A" melody pattern 27, one of variation patterns is arbitrarily selected from the channels of "A" melody pattern 27 to detect the number of notes involved in the selected variation pattern. In this manner, this procedure is successively repeated. And, the selection of the variation patterns is completed when the accumulative total number of the detected notes exceeds the syllable number of the entered syllable data file.

For example, after the combination of (A-B) is repeated three times, the accumulative total number of the detected notes may exceed the syllable number of the entered syllable data file in the halfway of the next "A" melody pattern 27. In this case, a resultant song is composed of Intro-A-B-A-B-A-B-A-Ending. It may be possible to add "B" melody in front of the ending part if there is some congruity. Thus, the composition of the resultant song can be changed to Intro-A-B-A-B-A-B-A-B-Ending.

The syllable data file may comprise soundless syllables representing pausing for breath. Thus, it is preferable that the total syllable number of the syllable data file includes the number of such soundless syllables. For example, it is preferable to assign two syllables to the period (.) and one syllable for the comma (,). Using such soundless syllables is effective to discriminate one sentence from another.

When the number of notes involved in the melody pattern is smaller or larger than the syllable number, it is possible to add or reduce an appropriate number of notes somewhere in the melody line so as to equalize the note number to the syllable number. When the syllable number is slightly larger than the note number of the melody line, it is possible to assign one note to two consecutive syllables.

Furthermore, it is possible to occasionally add shout or similar sound. The vocal type can be arbitrarily changed from male to female or to animal, or vice versa.

After the overall composition of the song and the performance pattern are determined in this manner, the syllable data are allocated to corresponding note groups of the melody data to generate vocal sounds. Each of allocated syllable data is converted into a MIDI message (i.e., a later-described NRPN message).

Hereinafter, practical data for the NRPN message will be explained.

Detailed examples:

Data Format=Bn63H<MSB>Bn62H<LSB>

MSB(CC#=99)=60H

LSB(CC#=98)=00H

In the above example, Bn is a so-called "control change" which transmits a message used as a control signal. Numeral 63 represents that the next data is MSB of the data designating the NRPN message. "H" represents that "63" is expressed by hexadecimal digits. Numeral 62 represents that the next data is LSB of the data designating the NRPN message.

The above-described NRPN message shows that a data entry for the vocal sound will succeed this message. More specifically, a syllable is designated according to the combination of the succeeding data entries of MSB and LSB. For example, when the Japanese pronunciation [a] is designated, an NPRN message having a data format "Bn63H60H62HBn06H00H26H00H" is transmitted. FIG. 4 shows practical examples of the data entry representing various Japanese pronunciations.

The melody producing section 6 also performs the display control of an image character displayed on a screen of a display unit 17. More specifically, the melody producing section 6 produces the data for letting the image character dance to the music or sing according to the text.

The data relating to such behaviors of the image character can be described beforehand in the standard MIDI file 2*a* by using the MIDI message format or Meta Event format.

The syllable designating data converted into the NRPN message, the melody data for producing vocal sounds, the background music data, and the image character data are summarized in a sequence table and sent to a sequencer section 8. Meanwhile, the color change information file and the text data file are sent to a musical performance display control section 15.

The sequence table sent to the sequencer section 8 is a table converted from the standard MIDI file and the syllable data. The sequence table enables the sequencer module to perform sequential playback. The description format of the sequence table may be similar to that of standard MIDI file 2*a* (i.e., Standard MIDI File 1.0). It is also possible to separate a display sequence table for the image character data from a musical performance sequence table including the syllable designating data, the melody data, and the background music data.

The sequencer section 8 is responsive to a user's playback request to perform the sequential playback in order of time in accordance with the entered sequence table. The reproduced data are successively sent to an output control section 9 in the same manner as a playback operation performed in an ordinary MIDI sequencer.

The output control section 9 converts the received sequence table into a performance information table recognizable by a software synthesizer 12. Thus, the performance information table is transmitted to the software synthesizer 12. The software synthesizer 12 operates as the output means 51 shown in FIG. 7. Furthermore, the output control section 9 sends the color change information to the musical performance display control section 15, and also sends the image character data to an image character display control section 16. It is, alternatively, possible to directly send the image character data from the melody producing section 6 to the image character display control section 16.

The software synthesizer 12 receives waveform data from a GM (General MIDI) waveform file 10, and uses the received waveform data to produce the backing music according to the supplied performance MIDI data. The produced backing music is sent to a sound output device 14, such as an amplifier and a speaker.

The software synthesizer 12 has a vocal sound producing section 13. The vocal sound producing section 13 receives the waveform data from a vocal waveform file 11 and uses the received waveform data to produce vocal sound data (i.e., vocal melody data) according to the interval data represented by the MIDI message and the syllable data represented by the NRPN message. The produced vocal sound data are sent to the sound output device 14. Thus, the backing or accompaniment music is produced in synchronism with the vocal sound 52 from the sound output device 14.

The waveform data stored in the vocal waveform file 11 may comprise animal or other voices in addition to male and female voices so that the user can select a favorable voice type according to his/her preference.

It is possible to replace the software synthesizer by an external hardware sound source.

The musical performance display control section 15 receives the color change information file and the text data file. Meanwhile, the output control section 9 supplies timing information designating the timing for color change. The timing information is generated to change the color of each word displayed on the screen of the display unit 17 in synchronism with the vocal sound generated from the sound output device 14. Thus, the color of respective words (text data) displayed on the display unit 17 is changed in response to the timing information so as to let a viewer know which part of the song the singing apparatus is now singing.

The image character display control section 16 controls the motion of the image character displayed on the display unit 17 in accordance with the supplied image character data. Thus, it becomes possible to make the image character dance to the music produced from the sound output device 14. Regarding the motion control of the image character, it is preferable to prepare a plurality of pictures and selectively display them to realize animated motion of the image character like the well-known animation GIF. Alternatively, it is possible to perform a real time display by the computer graphics.

According to the above-described arrangement, the entered text data become the words of a song producible from the sound output device 14. The singing part of the words (i.e., text data) is indicated by changing the color on the display unit 17. The image character dances to the song.

Figure 5:
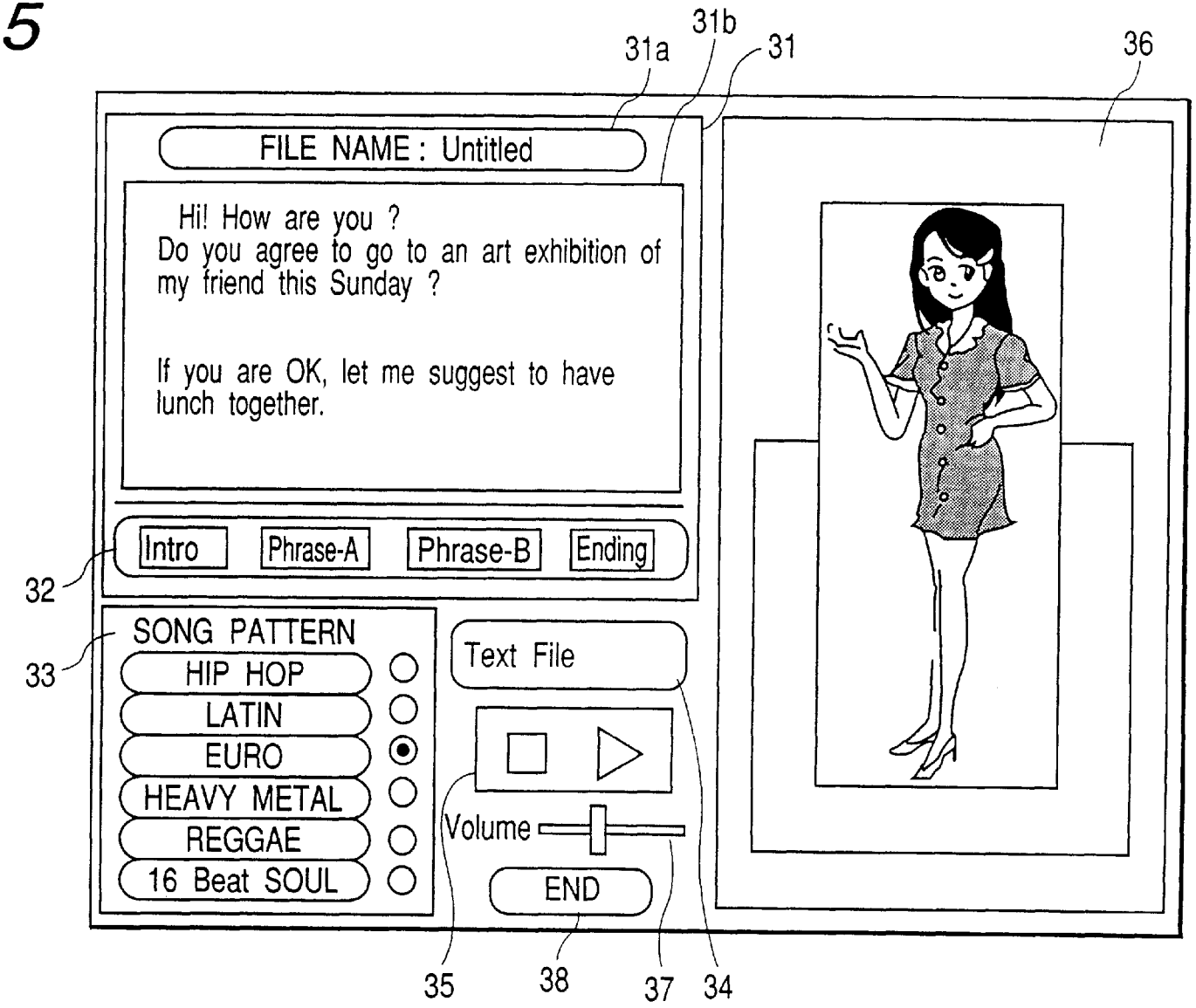
FIG. 5 is a view showing an example of a display screen of the singing apparatus shown in FIG. 1.
Figure 6:
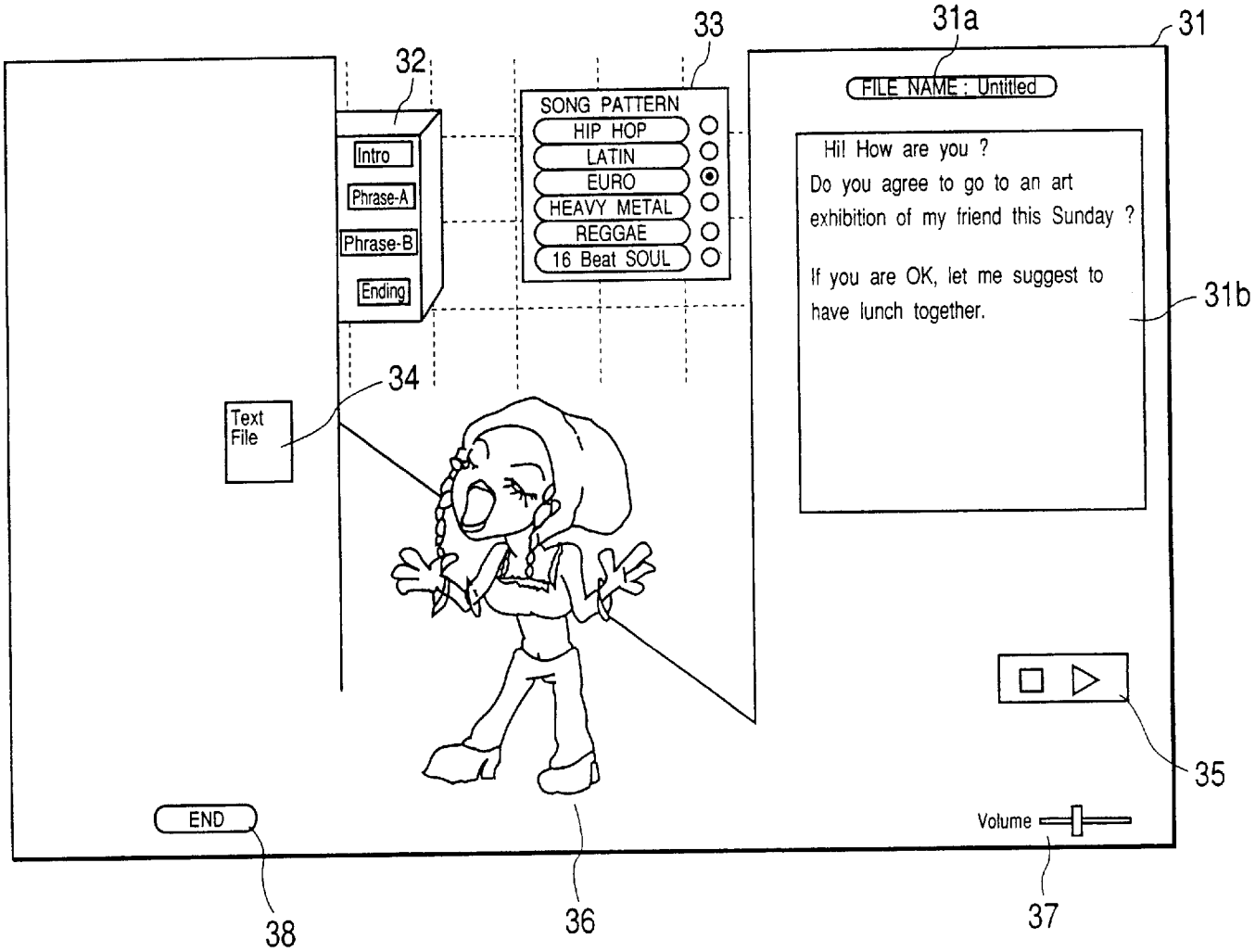
FIG. 6 is a view showing an example of a display screen of the singing apparatus shown in FIG. 1.

FIGS. 5 and 6 show examples of the display screen of the singing apparatus. The display screen has a text display area 31 consisting of a file name display field 31*a* for displaying a file name of the selected text data and a text display field 31*b* for displaying text data involved in this file name. The color of the singing part of the words (i.e., text data) is changed in accordance with the playback of the song. The information designating the color change timing is sent to the display unit 17 from the sequencer section 8 via the output control section 9 and the musical performance display control section 15.

Furthermore, the display screen has a playback part display field 32 having four display windows, i.e., i.e., Intro, Phase-A (i.e., A melody), Phase-B (i.e., B melody), and Ending. One of the four parts, i.e., Intro, Phase-A, Phase-B, and Ending, is indicated in accordance with the playback of the song. Thus, the playback part display field 32 lets the viewer know which part of the song the singing apparatus is now singing. The output control section 9 designates the playback part of the four display windows. For example, the playback part can be emphasized or highlighted by changing the color.

Furthermore, the display screen has a song pattern selecting area 33 having a plurality of menu buttons to select a preferable genre of the background music to be reproduced. To indicate the selected music genre, an indicator adjacent to the corresponding menu button is turned on. The indicator has a gray color to inform the user of unableness of canceling the selected genre until the playback of the selected song is completed.

An option button may be provided to allow the user to add a new song (or genre). In this case, a new standard MIDI file 2*a* for the newly added song (or genre) is added to the SMF memory section 2.

The backing or accompaniment data can be described together with the melody data in the same standard MIDI file 2*a* or separately described in another standard MIDI file 2*a*.

Furthermore, the display screen has a text file button 34. When the user pushes the text file button 34, a file selection window is opened to allow the user to select a preferable text file. After the text file selection is fixed, the title of the selected text file is displayed in the file name display field 31*a*. And, the whole contents of the selected text file is displayed in the text display field 31*b*. It is desirable that the text display field 31*b* has an editor arrangement so that the user can edit the text freely. In this case, it is further preferable to provide a saving function and a related means (e.g., a button) for saving the edited text file.

A playback/stop button 35 is provided to start the playback of the backing music and song (i.e., reading of the text data) or to stop it. The instruction entered through the playback/stop button 35 is used to control the sequencer section 8. When the playback instruction is entered again, the playback operation resumes from the previous stop position or newly starts from the beginning.

Furthermore, the display screen has an image character display area 36 displaying the image character dancing to the backing music. The information controlling the motion of the image character is sent to the display unit 17 from the sequencer section 8 via the output control section 9 and the image character display control section 16. It is preferable to prepare a plurality kinds of image characters so that the image character can be changed in accordance with the selected genre. It may be also preferable to perform the playback/stop operation by directly clicking the image character displayed on the screen.

A volume control slider 37 is provided to change the volume of the backing music or vocal sounds produced from the sound output device 14. An end button 38 is provided to stop the operation of the singing apparatus.

The functions of the above-described singing apparatus can be provided as an application program used in a personal computer or a mobile terminal. In this case, various types of text data supplied from the computer sources can be converted into syllable data. Each syllable data is assigned to a melody part of a preferable song. The interval of each syllable data can be changed in accordance with a melody line. Such singing program may be provided through the Internet or a recording medium. Thus, the user can realize the singing apparatus of the present invention by incorporating the obtained application program into his/her musical hardware devices. The control program for changing the color of the screen or displaying the image character can be additionally provided.

It is possible to obtain the standard MIDI file 2*a* from an external supplier through the Internet or a recording medium.

It is also possible to produce the melody (i.e., vocal sounds) only from the sound output section 14 without adding the backing music.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A singing apparatus comprises:

a syllable conversion means for converting text data into syllable information;

a vocal interval information generating means for generating vocal interval information;

an assigning means for changing said vocal information supplied from said vocal interval information generating means according to said syllable information converted by said syllable conversion means, thereby automatically assigning said syllable information to said vocal interval information; and an output means for generating a vocal sound of the assigned syllable information so as to have an interval variable in accordance with the corresponding vocal interval information.

2. The singing apparatus in accordance with claim 1, wherein a playing or performance time is dependent on said vocal interval information, and said assigning means is for performing the assignment of said syllable information according to said vocal interval information in such a manner that the playing or performance time can be varied in accordance with a syllable number of said syllable information.

3. The singing apparatus in accordance with claim 1, wherein said vocal interval information involves a total number of notes of a melody, and said assigning means is for performing the assignment of the syllable information according to the vocal interval information in such a manner that the number of notes of the melody is changed in accordance with the syllable number of said syllable information.

4. The singing apparatus in accordance with claim 1, wherein said assigning means is for performing the assignment of said syllable information according to said vocal interval information by selecting an optimum one of melodies stored in said vocal interval information generating means.

5. The singing apparatus in accordance with claim 1, wherein a separating means is provided for separating said syllable information into a plurality of syllable groups, and said assigning means is for assigning each of the separated syllable groups to said vocal interval information.

6. The singing apparatus in accordance with claim 1, wherein a backing information generating means is provided for generating backing or accompaniment information, and said output means is for generating backing or accompaniment in synchronism with said vocal sound of the syllable information which is generated in accordance with the vocal interval information.

7. The singing apparatus in accordance with claim 6, wherein a performance information storing means is provided for storing playing or performance information including said vocal interval information and said backing or accompaniment information.

8. The singing apparatus in accordance with claim 7, wherein said backing information generating means is for generating selected one of a plurality kinds of the backing or accompaniment information involved in the playing or performance information stored in said performance information storing means.

9. A recording medium storing a program performing steps of:

converting given text data into syllable information;

assigning said syllable information to desirable vocal interval information by changing said vocal interval information according to said syllable information; and generating vocal sound of assigned syllable information so as to have an interval variable in accordance with a melody of said vocal interval information.

10. The recording medium in accordance with claim 9, further storing playing or performance information including:

backing or accompaniment information to be reproduced as a background music; and said vocal interval information assigned to said syllable information.

11. A method for synthesizing vocal sounds in accordance with given text data, comprising the steps of:

converting text data into syllable information;

generating vocal interval information;

changing said vocal interval information according to said syllable information for automatically assigning said syllable information to said vocal interval information; and generating the vocal sound of the assigned syllable information so as to have an interval variable in accordance with the corresponding vocal interval information.

12. The vocal sound synthesizing method in accordance with claim 11, wherein a playing or performance time is dependent on said vocal interval information, and the assignment of said syllable information is performed according to said vocal interval information in such a manner that the playing or performance time can be varied in accordance with a syllable number of said syllable information.

13. The vocal sound synthesizing method in accordance with claim 11, wherein said vocal interval information involves a total number of notes of a melody, and the assignment of said syllable information is performed according to said vocal interval information in such a manner that the number of notes of the melody is changed in accordance with the syllable number of said syllable information.

14. The vocal sound synthesizing method in accordance with claim 11, wherein the assignment of the syllable information is performed according to said vocal interval information by selecting an optimum one of melodies.

15. The vocal sound synthesizing method in accordance with claim 11, wherein said syllable information is separated into a plurality of syllable groups, and each of the separated syllable groups is assigned to said vocal interval information.

16. The vocal sound synthesizing method in accordance with claim 11, wherein backing or accompaniment information is generated, and backing or accompaniment is generated in synchronism with said vocal sound of said syllable information which is generated in accordance with said vocal interval information.

* * * * *